US009273605B2

(12) United States Patent
Mendler

(10) Patent No.: US 9,273,605 B2
(45) Date of Patent: Mar. 1, 2016

(54) VARIABLE COMPRESSION RATIO ENGINE

(71) Applicant: Edward Charles Mendler, Los Angeles, CA (US)

(72) Inventor: Edward Charles Mendler, Los Angeles, CA (US)

( * ) Notice: Subject to any disclaimer, the term of this patent is extended or adjusted under 35 U.S.C. 154(b) by 33 days.

(21) Appl. No.: 13/261,928

(22) PCT Filed: Jan. 24, 2013

(86) PCT No.: PCT/US2013/000023
§ 371 (c)(1),
(2) Date: Jul. 11, 2014

(87) PCT Pub. No.: WO2013/119330
PCT Pub. Date: Aug. 15, 2013

(65) Prior Publication Data
US 2015/0096540 A1 Apr. 9, 2015

Related U.S. Application Data

(60) Provisional application No. 61/633,402, filed on Feb. 9, 2012.

(51) Int. Cl.
*F02B 75/04* (2006.01)
*F02D 15/00* (2006.01)

(52) U.S. Cl.
CPC ..... *F02B 75/047* (2013.01); *F02B 75/041* (2013.01); *F02D 15/00* (2013.01)

(58) Field of Classification Search
CPC ..... F02B 70/04; F02B 75/041; F02B 75/047; F02D 15/00; F02D 15/04
USPC ..... 123/48 R, 48 C, 78 R, 78 C
See application file for complete search history.

(56) References Cited

U.S. PATENT DOCUMENTS

| | | | |
|---|---|---|---|
| 5,562,069 | A | 10/1996 | Gillbrand et al. |
| 5,611,301 | A | 3/1997 | Gillbrand et al. |
| 7,047,917 | B2 | 5/2006 | Akihisa et al. |
| 8,166,929 | B2 | 5/2012 | Pattakos et al. |
| 8,474,420 | B2 | 7/2013 | Stolk et al. |
| 2002/0043229 | A1 | 4/2002 | Yapici |

(Continued)

*Primary Examiner* — Marguerite McMahon

(57) ABSTRACT

According to the present invention, a variable compression ratio engine includes a cylinder head and crankcase directly joined by a control shaft, thereby eliminating use of a link between the control shaft and cylinder head. The present invention has a low manufacturing cost and a small size ideal for mass production applications. In the preferred embodiment of the present invention, the control shaft includes a primary set of bearings and an eccentric set of bearings. The primary control shaft set of bearings are mounted directly in the crankcase assembly, and the eccentric control shaft bearings are mounted directly in the cylinder head assembly. There is only one control shaft per cylinder head, and there is no link between the control shaft and cylinder head assembly. The variable compression ratio mechanism also includes moment retaining means to prevent the cylinder head assembly from rotating out of alignment when the engine is running. The moment retaining means is a bushing that is mounted around the engine cylinder. The bushing provides the moment retaining means needed for holding the cylinder head assembly in alignment when the engine is running, and also provides displacement means, where the cylinder head assembly can slide on the bushing. The displacement means is needed to allow the cylinder head assembly to move relative to the crankcase when compression ratio is adjusted.

23 Claims, 8 Drawing Sheets

(56) References Cited

U.S. PATENT DOCUMENTS

| | | | | |
|---|---|---|---|---|
| 2004/0035376 | A1 | 2/2004 | Hoffmann et al. | |
| 2004/0163614 | A1 | 8/2004 | Hiyoshi et al. | |
| 2006/0070605 | A1 * | 4/2006 | Akihisa et al. | 123/478 |
| 2009/0188471 | A1 | 7/2009 | Jaquet | |
| 2010/0163002 | A1 | 7/2010 | Kamiyama | |
| 2012/0017876 | A1 | 1/2012 | Sawada et al. | |
| 2012/0080012 | A1 * | 4/2012 | Kodama | 123/48 R |
| 2012/0089316 | A1 * | 4/2012 | Cleeves et al. | 701/102 |
| 2013/0055989 | A1 | 3/2013 | Kawasaki | |
| 2014/0007848 | A1 * | 1/2014 | Pluta et al. | 123/48 R |

* cited by examiner

VARIABLE COMPRESSION RATIO ENGINE

This application relates to Provisional Application No. 61/633,402 having a filing date of Feb. 9, 2012.

BACKGROUND OF THE INVENTION

Variable compression ratio can significantly increase the fuel efficiency of reciprocating piston internal combustion engines used in passenger cars, light duty trucks and other vehicles. The present invention relates to a variable compression ratio mechanism having an eccentric control shaft for adjusting engine compression ratio.

An engine having an eccentric control shaft is shown by Per Gillbrand in U.S. Pat. Nos. 5,611,301 and 5,562,069. Referring to U.S. Pat. No. 5,562,069, a crankcase (4) is connected to a cylinder head assembly (2) with a hinge shaft (20). Use of the hinge shaft (20) enables the cylinder head assembly (2) to tip relative to the crankcase (4) for adjusting compression ratio. A control shaft (56) is also mounted in a crankcase (4). The engine has only one control shaft (56) per cylinder head assembly (2). The engine includes a straight second shaft (52) mounted in the cylinder head assembly (2), and a plurality of links (50) connecting the control shaft (56) to the second shaft (52). Rotating the control shaft (56) moves link (50) causing second shaft (52) to also move, causing cylinder head assembly (2) to tip relative to crankcase (4) resulting in a change of engine compression ratio. The engine is characterized in that at least one link (50) connects the control shaft (56) to the cylinder head assembly (2). The engine is assembled by sliding hinge shaft (20) into the engine to connect the crankcase (4) and cylinder head assembly (2), and sliding the second shaft (52) into the engine to connect the links (50) and the cylinder head assembly (2). The control shaft (56) includes eccentrics, preventing sliding in of the control shaft (56) to complete assembly. Accordingly, the links include removable bearing caps (60) so that the links (50) may be assembled onto the control shaft (56).

Machining and assembly tolerances are a problem with the variable compression ratio mechanism taught by Gillbrand. In particular, hinge shaft (20), control shaft (56) and second shaft (52) must be parallel for durable operation of the engine. Additionally, the shafts must remain true when the engine is running and exposed to high mechanical loads. Attaining precision alignment of the shafts can be attained, however, an undesirably massive crankcase is needed, and attaining tight machining tolerances is relatively costly. The engine has many links and hinge joints which also adds to manufacturing and alignment costs.

Another problem with the engine is that hinge shaft (20) is located relatively far from crankshaft (6) and the centerline axis of cylinder (10) in order to minimize the degree of tipping required to change compression ratio. Locating hinge shaft (20) and control shaft (56) relatively far from the cylinder centerline axis results in high moment forces in both crankcase (4) and cylinder head assembly (2). The high moment forces further increase the need for an undesirably massive and heavy crankcase. An in-line engine layout is employed to minimize weight and complexity, however the crankcase is still massive.

To accommodate tipping, the engine also includes tall crankcase walls (24) and a flexible gasket (44) between the crankcase (4) and cylinder head assembly (2). Another problem with the engine is noise and vibration because of the high crankcase walls (24) that are not anchored at their top, and the large gasket (44) which does not contain noise within the crankcase.

Another engine having one control shaft per cylinder head assembly is shown by Manousos Pattakos in U.S. Pat. No. 8,166,929. The engine is also characterized in that links (15) connects the control shaft (13) to the cylinder head assembly (9). The control shaft (13) is located generally in line with the cylinder centerline axis in order to minimize moment forces. However, a problem with the engine is that a massive and large cylinder head is needed to accommodate the links and control shaft in the cylinder head. The control shaft is located far above the combustion chamber roof and far away from the top of the cylinder in order to provide room for the links. An in-line engine layout is employed to minimize weight and complexity, however the crankcase is still massive. The engine has a relatively tall engine height which will make packaging in some automobiles impractical. Another problem with the engine is that there are a large number of eccentric bearings and links, which increases manufacturing and alignment cost.

An engine having two control shafts is shown by Daisuke Akihisa in U.S. Pat. No. 7,047,917. A problem with the variable compression ratio mechanism shown in U.S. Pat. No. 7,047,917 is that precision alignment of the two control shafts is required for durable operation of the engine, and attaining the precision alignment is costly. A second problem with the engine is that there are a large number of eccentric bearings, which increases manufacturing and alignment cost. An in-line engine layout is employed to minimize weight and complexity, however the crankcase is still relatively massive.

SUMMARY OF THE INVENTION

According to the present invention, a variable compression ratio engine includes a cylinder head and crankcase directly joined by a control shaft, thereby eliminating use of a link between the control shaft and cylinder head. The present invention has a low manufacturing cost and a small size ideal for mass production applications.

In the preferred embodiment of the present invention, the control shaft includes a primary set of bearings and an eccentric set of bearings. The primary control shaft set of bearings are mounted directly in the crankcase assembly, and the eccentric control shaft bearings are mounted directly in the cylinder head assembly. There is only one control shaft per cylinder head, and there is no link between the control shaft and cylinder head assembly. The variable compression ratio mechanism also includes moment retaining means to prevent the cylinder head assembly from rotating out of alignment when the engine is running. In an embodiment of the present invention, the moment retaining means is a bushing that is mounted around the engine cylinder. The bushing provides the moment retaining means needed for holding the cylinder head assembly in alignment when the engine is running, and also provides displacement means, where the cylinder head assembly can slide on the bushing. The displacement means is needed to allow the cylinder head assembly to move relative to the crankcase when compression ratio is adjusted.

The engine includes a seal for sealing between the crankcase assembly and the cylinder head assembly. A garter seal or other type of seal may be used that preferably slides along the same surface or bearing race on the cylinder head assembly as the bushing. Advantages of the sealing system of the present invention include low cost, high reliability and noise containment.

A significant benefit of the variable compression ratio mechanism of the present invention is its small size and light weight. The control shaft is mounted between the valve stems and close to the combustion chamber roof, near the top of the cylinder. The location of the control shaft near to the top of the cylinder is beneficial for the stoutness and stiffness of the variable compression ratio mechanism, while also providing a compact and light weight engine. A control shaft having a removable bearing and a fluted shaft may optionally be used to locate the control shaft as near as practical to the top of the cylinder. There is no link between the cylinder head assembly and control shaft to compromise the location of the control shaft or mandate a large heavy cylinder head construction.

The variable compression ratio mechanism of the present invention may be practiced in a number of different engine configurations, including in-line engines, V-engines and horizontally opposed piston engines. In an embodiment of the present invention, the engine has only two cylinders, and has a generally horizontally opposed piston layout, commonly referred to as a Boxer engine layout. According to the present invention, the control shafts in the Boxer engine are short and sturdy, and have only one pair of primary control shaft bearings and only one pair of eccentric bearings, resulting in easily attainable machining and assembly tolerances, low manufacturing cost, and a sturdy, compact light-weight variable compression ratio engine. Preferably the crankcase has a clamshell construction where a front half of the crankcase slides onto the front end of the crankshaft, and a rear half of the crankcase slides onto the rear half of the crankshaft, with the two halves bolted together to form a low cost sturdy crankcase construction. Preferably the front and rear crankcase halves include armatures that capture and house the primary control shaft bearings, making for a light weight very low cost crankcase construction.

DETAILED DESCRIPTION OF THE PREFERRED EMBODIMENTS

Figure 1:
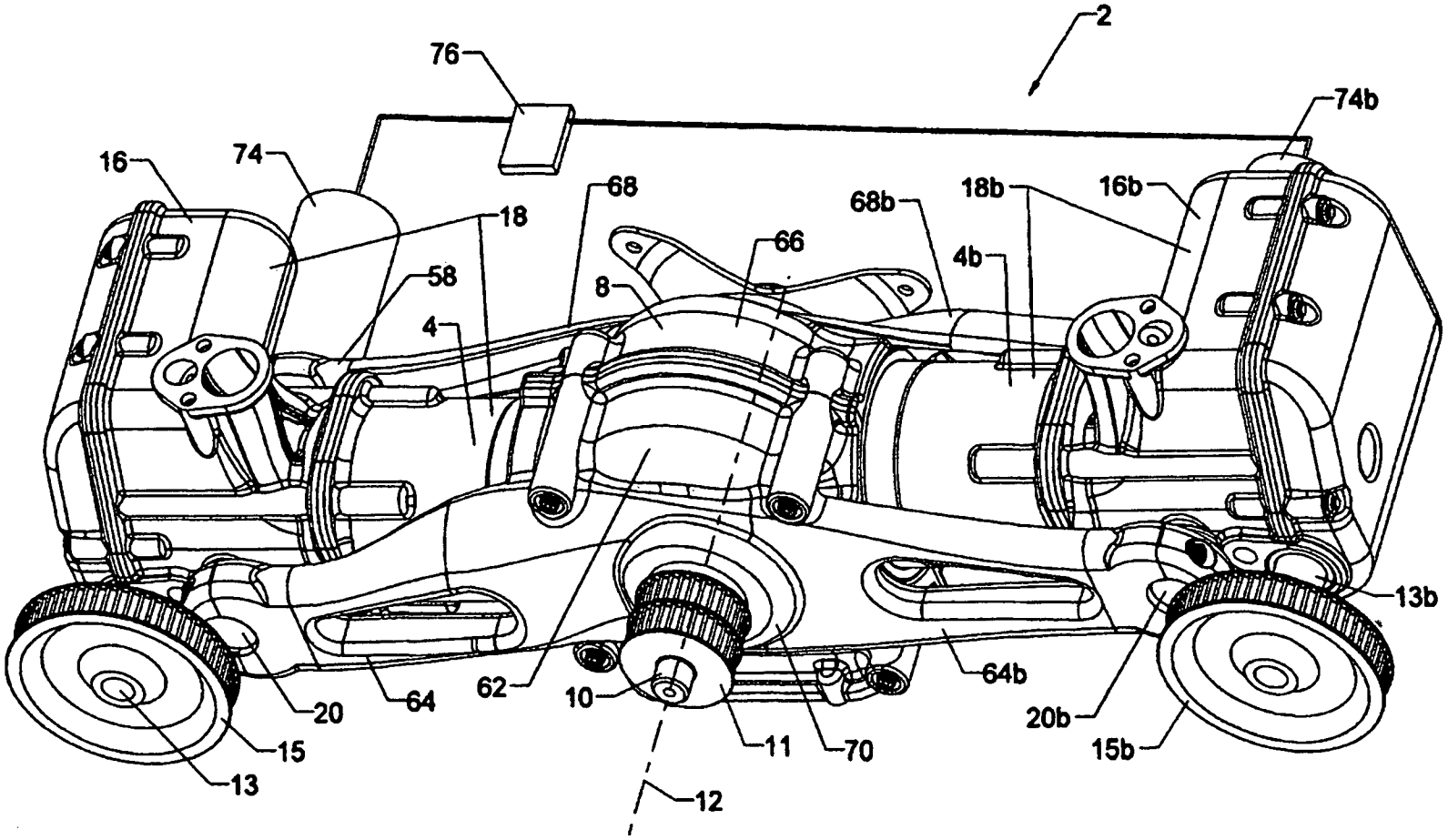
FIG. 1 is an illustration showing the schematic configuration of an engine to which the present invention is applied.
Figure 2:
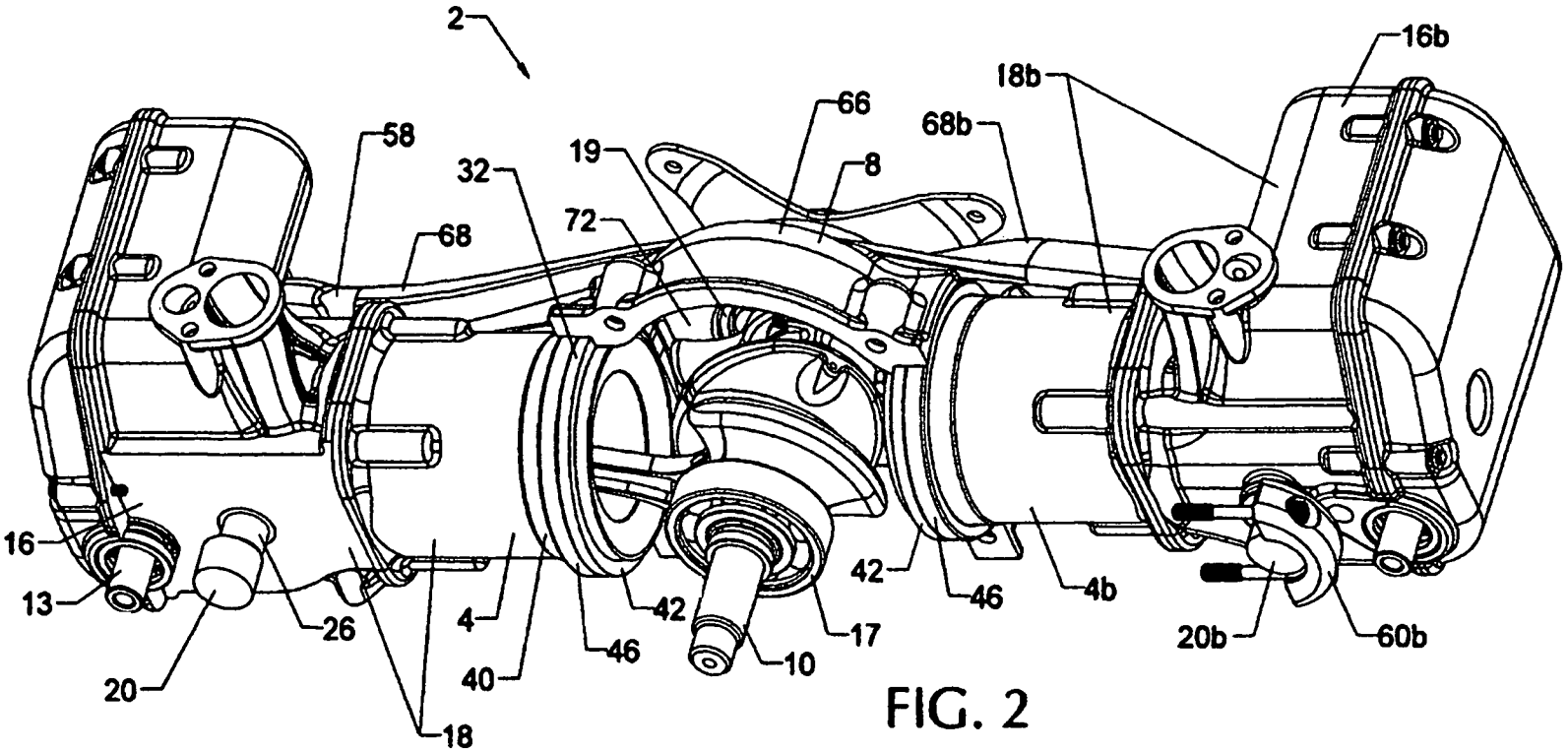
FIG. 2 is similar to FIG. 1, but having the front portion of the crankcase removed.
Figure 3:
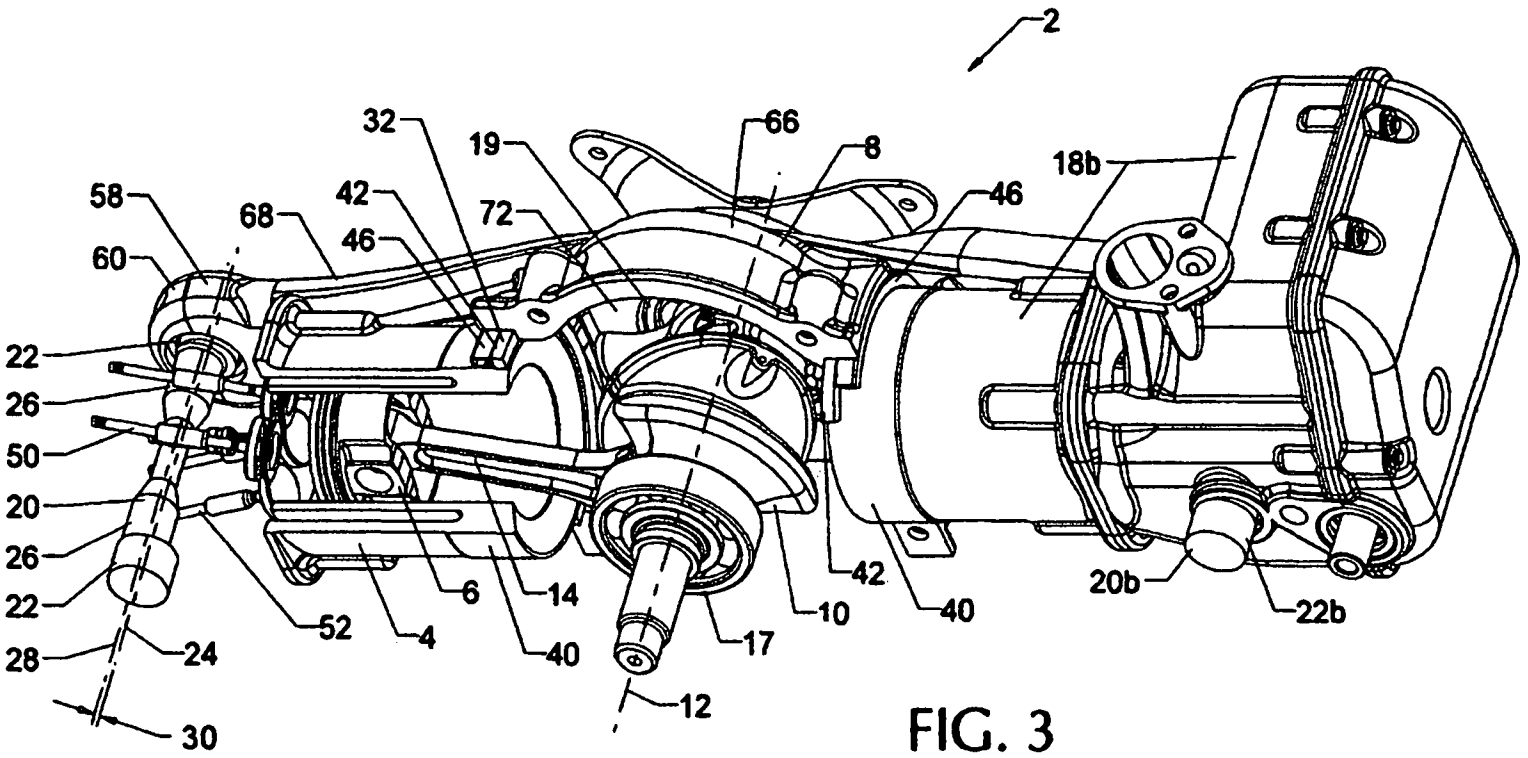
FIG. 3 is similar to FIG. 2, but having a cylinder head casting removed and a portion of the cylinder cut away to show inside of the engine.

FIGS. 1, 2 and 3 are intended to illustrate an engine 2 having a variable compression ratio mechanism according to the present invention. FIGS. 2 is similar to FIG. 1, but shows a portion of the crankcase and cylinder head removed to show the variable compression ratio mechanism in greater detail. Engine 2 has at least one cylinder 4. FIG. 3 is similar to FIG. 2, but shows a portion of cylinder 4 cut away to better show the variable compression ratio mechanism of the present invention. The cylinder head casting is also hidden to better show the variable compression ratio mechanism.

Engine 2 has a piston 6 mounted for reciprocating movement in cylinder 4, and a crankcase assembly 8. A crankshaft 10 is rotatably mounted in crankcase 8, crankshaft 10 defining a crankshaft axis 12 about which crankshaft 10 rotates in crankcase 8. Engine 2 has at least one connecting rod 14 connecting piston 6 to crankshaft 10. Engine 2 also has a cylinder head 16 for sealing cylinder 4, and a cylinder head assembly 18, cylinder head 16 and cylinder 4 being part of cylinder head assembly 18. Cylinder head 16 seals high pressure combustion gasses in cylinder 4. Cylinder head 16 and cylinder 4 may be assembled together or be part of the same casting. Crankshaft 10 has at least a front main bearing 17 and a rear main bearing 19. Ball bearings are shown, however journal bearings and other types of roller bearings may optionally be used according to the present invention.

According to the preferred embodiment of the present invention, engine 2 has a control shaft 20. Control shaft 20 has one or more primary control shaft bearings 22 defining a control shaft axis 24, and control shaft 20 has one or more eccentric bearings 26 defining an eccentric bearing axis 28. Eccentric bearing axis 28 has a first offset distance 30 from control shaft axis 24. According to the present invention, engine 2 has no more than one control shaft 20 with offset distance 30 per cylinder head assembly 18. Primary control shaft bearings 22 are mounted in crankcase assembly 8, and eccentric bearings 26 are mounted in cylinder head assembly 18 for holding cylinder head assembly 18 on crankcase 8 during operation of engine 2. According to the present invention, there is no link between eccentric bearings 26 and cylinder head assembly 18. According to the present invention, eccentric bearings 26 are housed in cylinder head assembly 18, and primary control shaft bearings 22 are housed in crankcase assembly 8.

Figure 4:
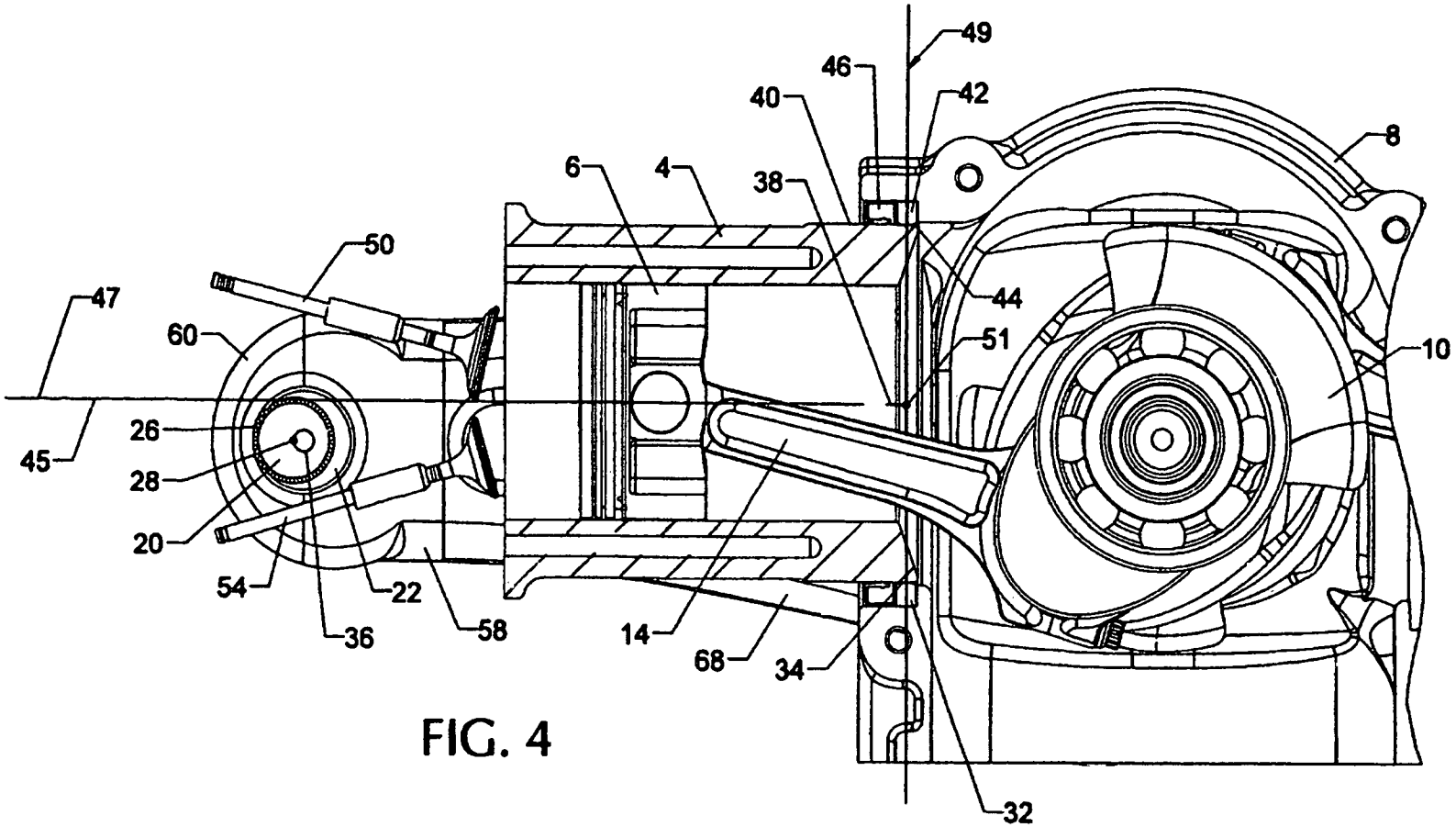
FIG. 4 is a partial section view showing the low compression ratio setting of the engine.

Referring now to FIGS. 3 and 4, according to the present invention, engine 2 further includes moment retaining means 32 for preventing rotation of cylinder head assembly 18 about control shaft axis 24 during operation of engine 2, and in more detail, for preventing movement of cylinder head assembly 18 around control shaft axis 24 when compression ratio is not being adjusted. The moment retaining means 32 further includes displacement means 34 for preventing eccentric bearings 26 from being over loaded or binding in cylinder head assembly 18 during adjustment of compression ratio. In more detail, displacement means 34 permits relocation of eccentric bearings 26 in crankcase 8 during adjustment of compression ratio. In more detail, displacement means 34 permits movement and relocation of eccentric bearings axis 28 in crankcase 8 during adjustment of compression ratio.

Cylinder 4 has a generally cylindrical interior for reciprocating movement of piston 6 in cylinder 4. The exterior of cylinder 4 may optionally have different shapes and constructions. Cylinder 4 may optionally be a single cast piece or include a cylinder liner formed in a similar or different type material.

According to an embodiment of the present invention, engine 2 includes a bearing race 40 around cylinder 4, and a bushing 42 mounted or housed in crankcase 8. Bearing race 40 May be assembled onto cylinder 4, or formed directly on cylinder 4. Preferably bearing race 40 has a generally cylindrical form around cylinder 4. According to the present invention, cylinder 4 is mounted inside bushing 42, and bushing 42 rides on bearing race 40. Bushing 42 is slidably mounted on bearing race 40 to enable movement of cylinder head assembly 18 relative to crankcase 8 for adjustment of engine compression ratio. In more detail the term slidably mounted means that bushing 42 can slide on bearing race 40. Bushing 42 restrains cylinder head assembly 18, and prevents rotation of cylinder head assembly 18 about control shaft axis 24 during operation of engine 2, and in more detail, bushing 42 prevents movement of cylinder head assembly 18 around control shaft axis 24 when compression ratio is not being adjusted. According to the present invention, bushing 42 provides both moment retaining means 32 and displacement means 34. Optionally, bushing 42 may be housed in cylinder head assembly 18, and bearing race 40 may be located in crankcase assembly 8 (not shown), where an outer surface of bushing 42 bears on an inner surface of race 40. Optionally, a link (not shown) may be used to provide moment retaining means 32 and displacement means 34, where the link has a first pin connection with cylinder head assembly 18 and a second pin connection with crankcase assembly 8. The optional link is characterized in not being connected to control shaft 20.

Figure 5:
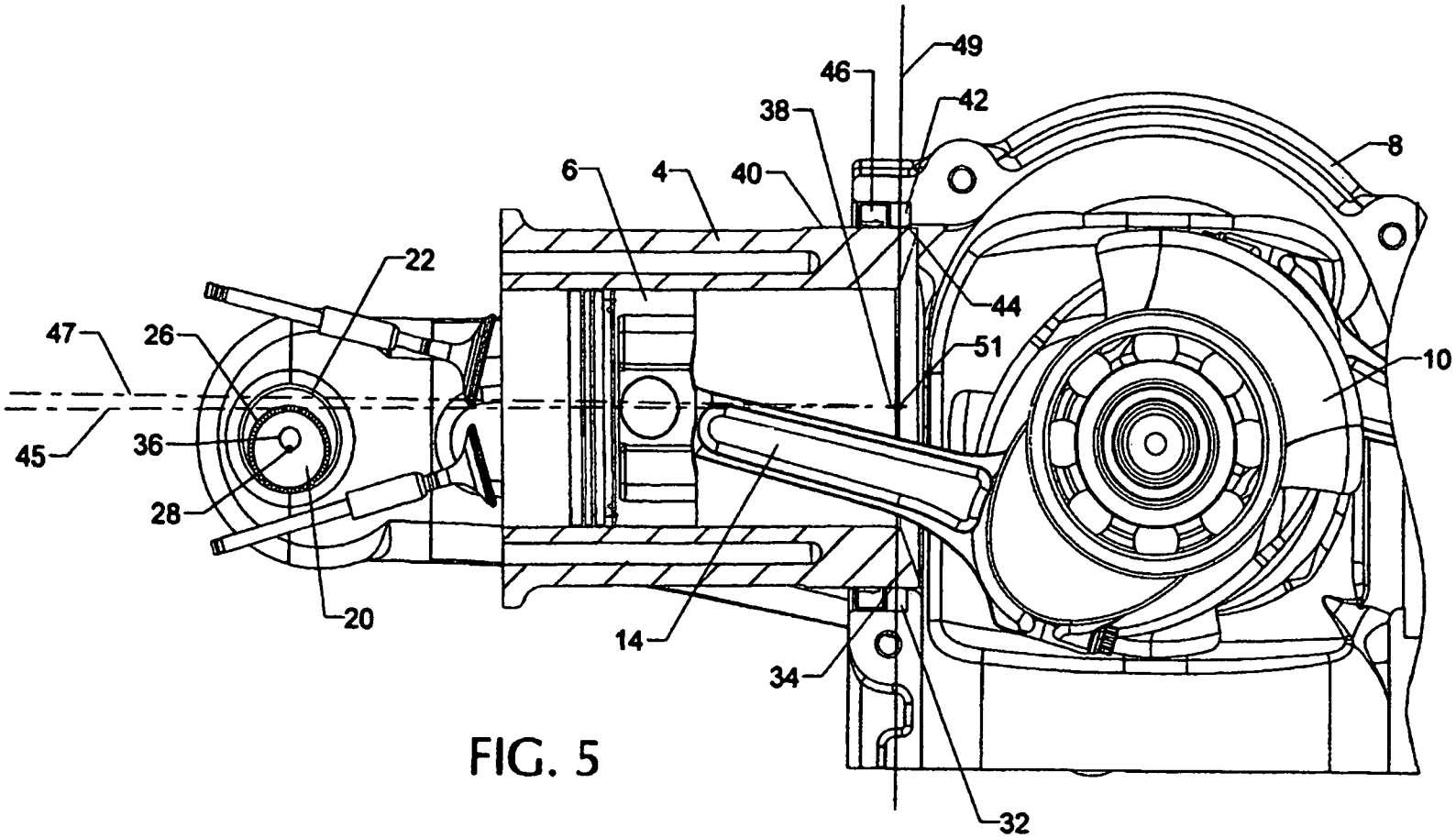
FIG. 5 is a partial section view showing the mid compression ratio setting of the engine.
Figure 6:
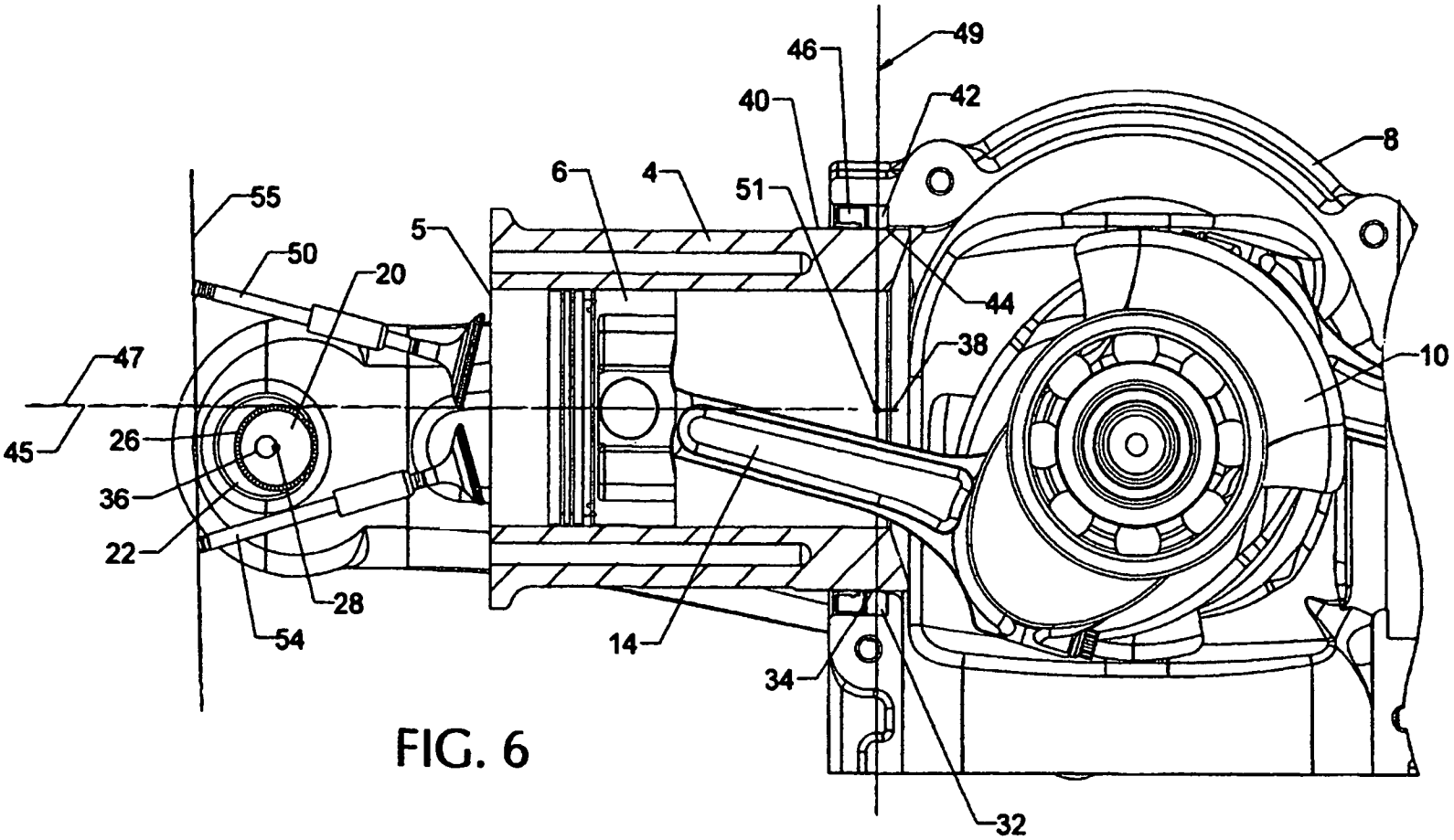
FIG. 6 is a partial section view showing the high compression ratio setting of the engine.

FIGS. 4, 5 and 6 show sectional views of a portion of engine 2. FIG. 4 shows a low compression ratio setting; FIG. 5 shows a mid-compression ratio setting; and FIG. 6 shows a high compression ratio setting of engine 2. Referring now to FIG. 5 bushing 42 has a crowned surface 44 in contact with bearing race 40. Crowned surface 44 permits tipping of cylinder 4 relative to bushing 42 during mid compression ratio settings. Cylinder 4 has a cylinder centerline axis 45, and bushing 42 has a bushing centerline axis 47. During mid compression ratio settings, cylinder centerline axis 45 tips away from bushing centerline axis 47. Preferably, according to the present invention, bushing 42 or an alternate moment retaining means 32 is located on the lower half of cylinder 4, and in more detail on the half of cylinder 4 closest to crankshaft axis 12 in order to minimize the maximum tipping angle between cylinder center axis 45 and bushing centerline axis 47. In engines not having bushing 42, centerline axis 47 is defined as the cylinder centerline axis at the highest compression ratio setting.

Preferably, engine 2, includes a seal 46 for sealing between crankcase 8 and cylinder head assembly 18. Preferably seal 46 is in sealing contact with bearing race 40, and preferably seal 46 has slidable sealing contact with bearing race 40 to permit movement of cylinder head 18 with change of compression ratio. A secondary race can optionally be used for forming a seal between crankcase 8 and cylinder head assembly 18, however, using bearing race 40 for both sealing and support of bushing 42 provides a lower cost. Preferably seal 46 rides on a generally cylindrical race around cylinder 4 in order to minimize seal and race manufacturing cost. Preferably, according to the present invention, seal 46 has a location generally adjacent to bushing 42 for minimizing misalignment between seal 46 and bearing race 40. Misalignment between seal 46 and bearing race 40 is minimized according to the present invention by minimizing the tipping angle and by locating seal 46 near or generally adjacent to bushing 42.

Figure 8:
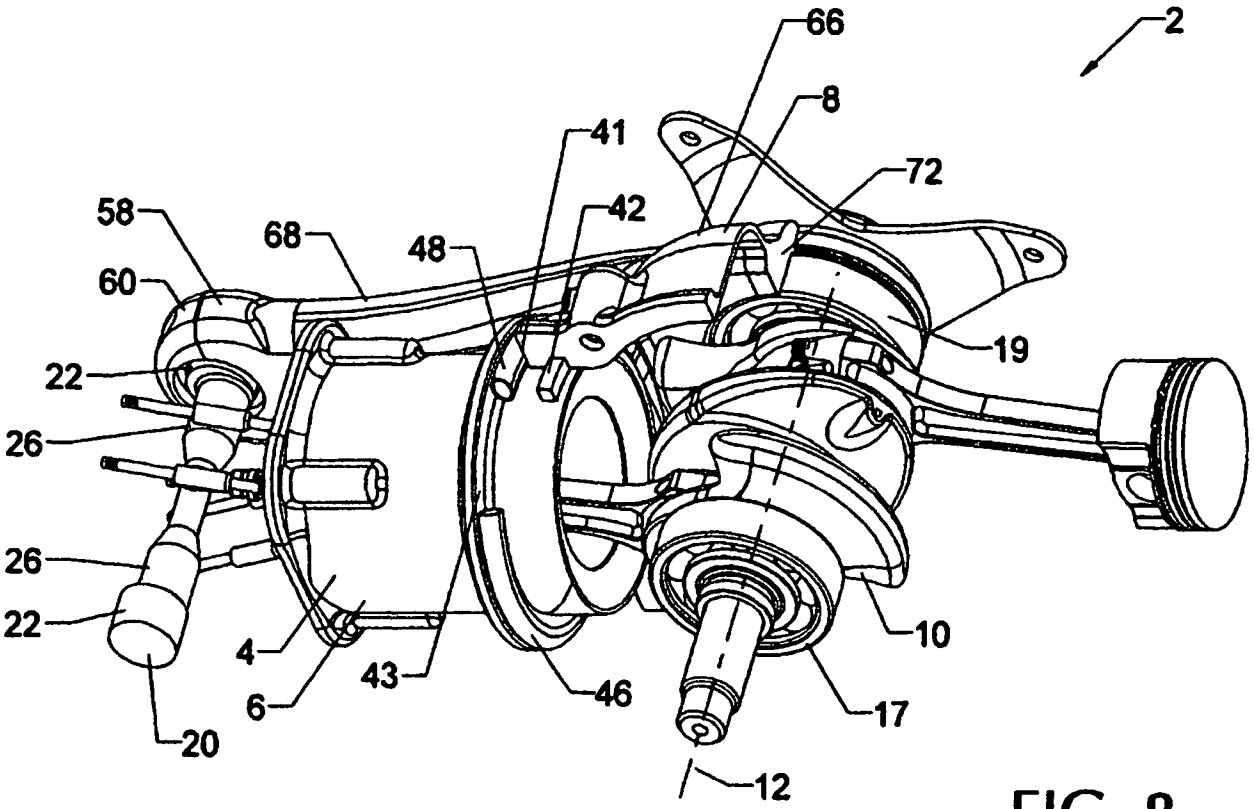
FIG. 8 is similar to FIG. 3, but shows a compressible seal, and has a portion of the crankcase cut away to show the rear main bearing and the rear main bearing support structure.

Referring now to FIG. 8, seal 46 may optionally be an O-ring or another type of compressible seal 48. A portion of seal 46 is cut away in FIG. 8 to show the seals O-ring cross section. Compressible seal 48 forms a seal between a first sealing surface 41 on crankcase 8 and a second sealing surface 43 on cylinder head assembly 18 or cylinder 4 by elastically deforming with change of compression ratio. Preferably compressible seal 48 generally encircles an individual cylinder 4. Optionally, compressible seal 48 may encircle more than one cylinder. For example, a single O-Ring may optionally be used to seal two adjacent cylinders in a horizontally opposed 4-cylinder Boxer engine. Preferably, compressible seal 48 has a location generally adjacent or near to bushing 42 for minimizing misalignment between the sealing surface 43 on cylinder 4 and the sealing surface 41 on crankcase 8.

A flexible gasket may also be used to provide a seal between the crankcase 8 and cylinder head assembly 18, for example in engines having a chain driven camshaft requiring the chain drive compartment to be sealed (not shown).

Referring now to FIGS. 3 through 6, engine 2 has a first transit path 36 in crankcase 8. Transit path 36 is the path along which eccentric bearing axis 28 travels in crankcase 8 with change of compression ratio. The location of eccentric bearing axis 28 on transit path 36 is different at different compression ratio values, as can be seen in FIGS. 4, 5 and 6.

Bushing 42 has a reference plain 49. Reference plane 49 is perpendicular to bushing central axis 47, and reference plane 49 generally passes through the mid-section of bushing 42. The intersection of cylinder central axis 45 and reference plane 49 defines a point 51 in cylinder head assembly 18. The location of point 51 in cylinder head assembly 18 is different for different engine compression ratio values as can be seen in FIGS. 4, 5 and 6. The array of points 51 for all compression ratio settings of engine 2 defines a second transit path 38 in cylinder head assembly 18. Engine 2 has a first transit path 36 and a second transit path 38 for adjustment of engine compression ratio. According to the present invention, first transit path 36 has both a different location and a different shape than second transit path 38.

Figure 7:
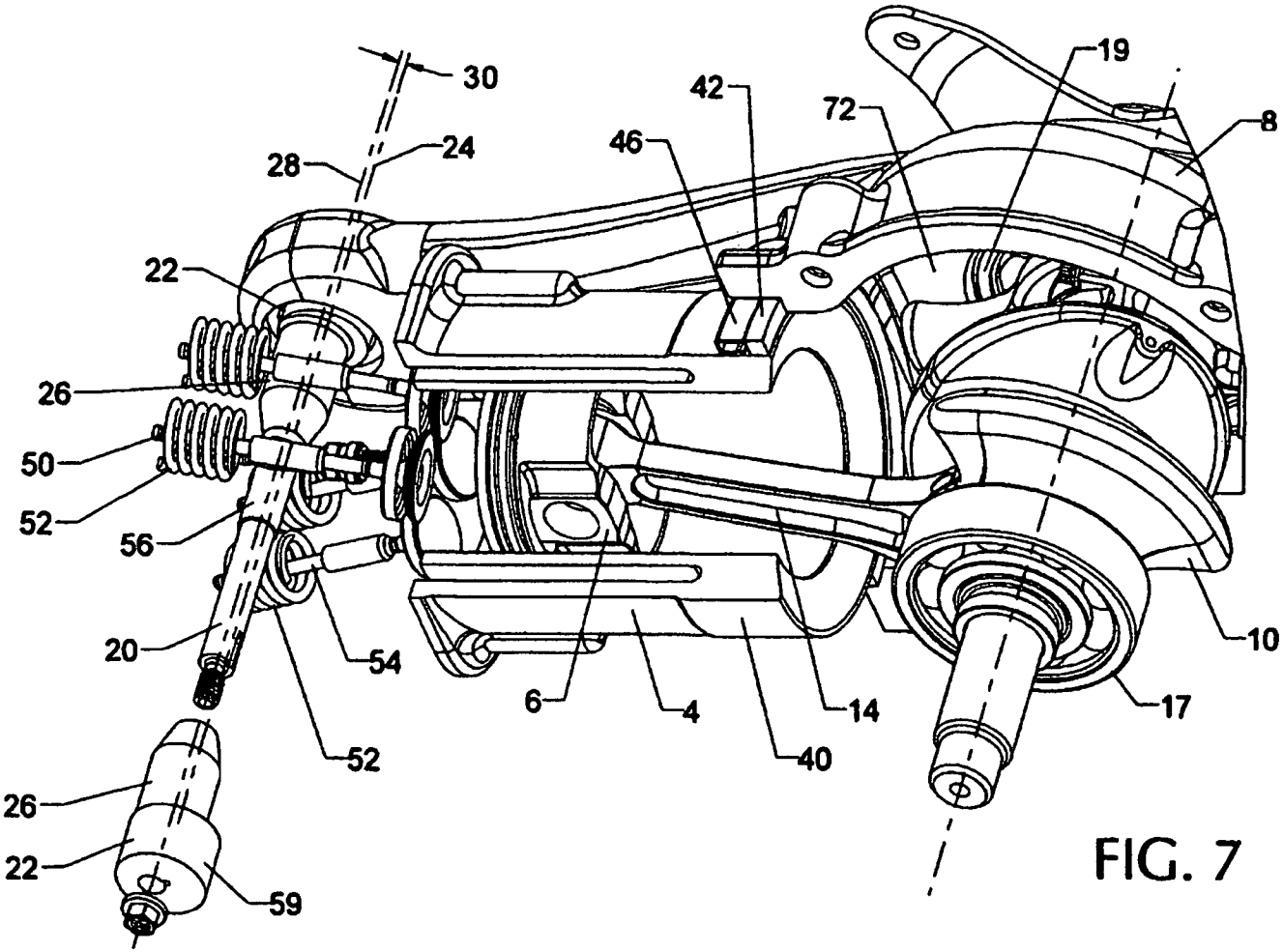
FIG. 7 is a partial section view of the engine showing construction of the control shaft.

Referring now to FIGS. 1 and 7, a small engine width and a small package size is highly desirable for mass production engines. Additionally, locating control shaft 20 as close as practical to cylinder 4 is highly desirable for maximizing engine sturdiness. Optionally, control shaft 20 includes a removable bearing 59 for assembly of control shaft 20 in cylinder head 16. In more detail, removable bearing 59 permits control shaft 20 to be located closer to cylinder 4 for providing a sturdier and more compact variable compression ratio engine.

Engine 2 includes, at least one intake valve 50 having at least one valve spring 52, and at least one exhaust valve 54 having at least one valve spring 52. Intake valve 50, valve springs 52 and exhaust valve 54 are located in cylinder head 16. Preferably control shaft 20 includes a fluted shaft 56 for clearance from at least one valve, spring 52 for free rotation of control shaft 20 without touching spring 52. Fluted shaft 56 permits control shaft 20 to be located closer to cylinder 4 for providing a sturdier and more compact variable compression ratio engine.

Referring now to FIG. 6, engine 2 includes a reference plane 55 passing through the outer end of intake valve 50 and the outer end of exhaust valve 54 when the valves are closed. Reference plane 55 is parallel to eccentric bearing axis 28. Cylinder 4 has a cylinder end 5, cylinder end 5 being located at the combustion end of cylinder 4. Preferably, according to the present invention, eccentric bearing axis 28 and second transit path 38 are located between reference plane 55 and cylinder end 5 for minimizing engine package size and maximizing engine rigidity. Preferably, eccentric bearing axis 28 and second transit path 38 are located between intake valve 50 and exhaust valve 54 for maximizing engine rigidity.

Referring now to FIGS. 1 through 4 and FIG. 8, crankcase 8 preferably includes at least one armature 58 for supporting control shaft bearings 22. Preferably, according to the present invention, armature 58 extends beyond piston 6 for installation and support of control shaft 20 in cylinder head 16. Optionally, armature 58 includes bearing caps 60 for installation of control shaft 20 in armature 58.

Preferably crankcase 8 includes a front structure 62 having a front armature 64, and a rear structure 66 having a rear armature 68, where front structure 62 includes a front main bearing support structure 70 for supporting front main bearings 17, and rear structure 66 includes a rear main bearing support structure 72 for supporting rear main bearings 19. According to an embodiment of the present invention, crankcase 8 includes the rigid assembly of front structure 62 and rear structure 66, and front armature 64 and rear armature 68 housing control shaft bearings 22, for holding cylinder head assembly 18 on crankcase 8 during operation of engine 2. Armatures 58, 64 and 68 may be part of the crankcase castings as shown in FIGS. 1 through 4 and FIG. 8, or assembled onto the crankcase casting.

In an embodiment of the present invention, engine 2 has a generally horizontally opposed piston layout, commonly referred to as a Boxer engine layout. In more detail, engine 2 has a second cylinder head assembly 18*b*, the second cylinder head assembly 18*b* being located generally on the opposite side of crankshaft 10 from the first cylinder head assembly 18. Cylinders that are spaced 180 crank angel degrees apart provides an exactly horizontally opposed piston layout. A generally horizontally opposed piston layout is specified for the current invention, to permit use of cylinders that are spaced apart by less than 180 crank angle degrees in order to provide for improved packaging within an automobile or other type of vehicle. Optionally, engine 2 may have a V-engine layout. Preferably, the second cylinder head assembly 18*b* has a second control shaft 20*b* having second control shaft bearings 22*b*. Front structure 62 further includes a second front armature 64*b*, and rear structure 66 further including a second rear armature 68*b*. Second front armature 64*b* and second rear armature 68*b* houses second control shaft bearings 22*b* for holding second cylinder head assembly 18*b* on crankcase 8 during operation of engine 2.

In another embodiment of the present invention, the engine has only two cylinders 4, and has a generally horizontally opposed piston Boxer engine layout. According to the present invention, the control shafts 20 in the Boxer engine are short and sturdy, and have only one pair of primary control shaft bearings 22 and only one pair of eccentric bearings 26, resulting in easily attainable machining and assembly tolerances, low manufacturing cost, and a sturdy, compact light-weight variable compression ratio engine.

In an embodiment of the present invention, engine 2 has no more than two cylinders 4, and cylinder head assembly 18 has only one cylinder 4, thereby providing a low cost and durable variable compression ratio engine. Preferably, engine 2 further has a generally horizontally opposed piston layout, with second cylinder head assembly 18*b* being located generally on the opposite side of crankshaft 10 from cylinder head assembly 18, and second cylinder head assembly 18*b* having a second control shaft 20*b* having second control shaft bearings 22*b*, for providing variable compression in both cylinder head assemblies.

In an embodiment of the present invention, engine 2 has only one pair of primary control shaft bearings 22 per cylinder head assembly 18, for minimizing machining and alignment cost. Also in an embodiment of the present invention, engine 2 has only one pair of eccentric bearings 26 per cylinder head assembly 18, thereby minimizing machining and alignment cost. This embodiment may be practiced in 2-cylinder Boxer engines and also in engines having a plurality of adjacent cylinders, such as in a 4-cylinder Boxer engine.

Referring now to FIG. 1, in another embodiment of the present invention, engine 2 including a first actuator 74 for rotating control shaft 20, and a second cylinder head assembly 18*b* and a second control shaft 20*b* having a second actuator 74*b* for rotating second control shaft 20*b*. According to the present invention, second actuator 74*b* may includes independent control means 76 for independent motion control of second control shaft 20*b* relative to control shaft 20, or optionally engine 2 may have control means 76 for providing generally the same motion for second control shaft 20*b* as for control shaft 20. Optionally, the compression ratio range for the two cylinder head assemblies may be different, for example offset distance 30 may be larger for control shaft 20 than for second control shaft 20*b*. Optionally one cylinder head may have variable compression ratio, and the other cylinder head may have a fixed compression ratio.

According to the present invention, engine 2 has compression ratio lock-up at maximum and minimum compression ratio, and more generally, engine 2 has compression ratio lock-up at a first compression ratio setting. In more detail, according to the present invention, compression ratio lock-up is provided by locating eccentric bearing axis 28 relative to primary control shaft axis 24 such that moment forces acting on control shaft 20 during operation of engine 2 are relatively small.

The invention claimed is:

1. A variable compression ratio mechanism for an engine (2) having at least one cylinder (4), a piston (6) mounted for reciprocating movement in cylinder (4), a crankcase assembly (8), a crankshaft (10) rotatably mounted in crankcase (8), crankshaft (10) defining a crankshaft axis (12) about which crankshaft (10) rotates in crankcase (8), a connecting rod (14) connecting piston (6) to crankshaft (10), a cylinder head (16) for sealing cylinder (4), and a cylinder head assembly (18), cylinder head (16) and cylinder (4) being part of cylinder head assembly (18), crankshaft (10) having at least a front main bearing (17) and a rear main bearing (19), and, a control shaft (20) having one or more primary control shaft bearings (22) defining a control shaft axis (24), and having one or more eccentric bearings (26) defining an eccentric bearing axis (28), eccentric bearing axis (28) having a first offset distance (30) from control shaft axis (24), engine (2) having no more than one control shaft (20) with offset distance (30) per cylinder head assembly (18), wherein primary control shaft bearings (22) are mounted in crankcase assembly (8), and eccentric bearings (26) are mounted in cylinder head assembly (18) for holding cylinder head assembly (18) on crankcase (8) during operation of engine (2), and moment retaining means (32) for limiting rotation of cylinder head assembly (18) about control shaft axis (24) during operation of engine (2), moment retaining means (32) further including displacement means (34) for permitting relocation of eccentric bearing axis (28) in crankcase (8) during adjustment of compression ratio.

2. The variable compression ratio mechanism of claim 1, wherein moment retaining means (32) is a bushing (42), bushing (42) providing moment retaining means (32) and displacement means (34).

3. The variable compression ratio mechanism of claim 2, further including a bearing race (40) around cylinder (4), wherein moment retaining means (32) is a bushing (42) mounted in crankcase (8), bushing (42) being slidably mounted on bearing race (40) for providing moment retaining means (32) and displacement means (34).

4. The variable compression ratio mechanism of claim 3, wherein bushing (42) has a crowned surface (44) in contact with bearing race (40), crowned surface (44) permitting tipping of the cylinder centerline axis (45) away from the bushing centerline axis (47).

5. The variable compression ratio mechanism of claim 3, further including a seal (46) for sealing between crankcase (8) and cylinder head assembly (18), wherein seal (46) is in sealing contact with bearing race (40), seal (46) having slidable contact with bearing race (40).

6. The variable compression ratio mechanism of claim 5, wherein seal (46) has a location generally adjacent to bushing (42) for minimizing misalignment between seal (46) and bearing race (40).

7. The variable compression ratio mechanism of claim 1, further including a seal (46) for sealing between crankcase (8) and cylinder head assembly (18), wherein seal (46) generally encircles cylinder (4), seal (46) being a compressible seal (48).

8. The variable compression ratio mechanism of claim 7, wherein seal (46) further has a location generally adjacent to bushing (42) for minimizing misalignment between seal (46) and bearing race (40).

9. The variable compression ratio mechanism of claim 2, further having a first transit path (36) in crankcase (8), eccentric bearing axis (28) defining first transit path (36) along which eccentric bearing axis (28) travels in crankcase (8), cylinder (4) having a cylinder central axis (45), and bushing (42) having a bushing central axis (47), bushing (42) further having a reference plain (49), reference plane (49) being perpendicular to bushing central axis (47), wherein the intersection of cylinder central axis (45) and reference plane (49) defines a point (51) in cylinder head assembly (18), the location of point (51) in cylinder head assembly (18) being different for different engine compression ratio values, wherein the array of points (51) for all compression ratio settings of engine (2) defines a second transit path (38) in cylinder head assembly (18), engine (2) having a first transit path (36) and a second transit path (38) for adjustment of engine compression ratio.

10. The variable compression ratio mechanism of claim 1, further including a removable bearing (59) on control shaft (20), for assembly of control shaft (20) in cylinder head (16).

11. The variable compression ratio mechanism of claim 1, further including at least one intake valve (50) having at least one valve spring (52), and at least one exhaust valve (54) having at least one valve spring (52), intake valve (50), valve springs (52) and exhaust valve (54) being located in cylinder head (16), wherein control shaft (20) further includes a fluted shaft (56) for clearance from at least one valve spring (52) for free rotation of control shaft (20) without touching spring (52).

12. The variable compression ratio mechanism of claim 1, further including a reference plane (55) passing through the outer end of intake valve (50) and the outer end of exhaust valve (54), reference plane (55) being parallel to eccentric bearing axis (28), cylinder (4) having a cylinder end (5), cylinder end (5) being located at the combustion end of cylinder (4), eccentric bearing axis (28) being located between reference plane (55) and cylinder end (5) for minimizing engine package size and maximizing engine rigidity.

13. The variable compression ratio mechanism of claim 12, wherein eccentric bearing axis (28) is located between intake valve (50) and exhaust valve (54) for minimizing engine package size and maximizing engine rigidity.

14. The variable compression ratio mechanism of claim 1, wherein crankcase (8) includes at least one armature (58) for supporting control shaft bearings (22), wherein armature (58) extends beyond piston (6) for installation and support of control shaft (20) in cylinder head (16).

15. The variable compression ratio mechanism of claim 14, further including removable bearing caps (60) for installation of control shaft (20) in armature (58).

16. The variable compression ratio mechanism of claim 1, wherein crankcase (8) includes a front structure (62) having a front armature (64), and a rear structure (66) having a rear armature (68), wherein front structure (62) includes a front main bearing support structure (70) for supporting front main bearings (17), and rear structure (66) includes a rear main bearing support (72) for supporting rear main bearings (19), wherein crankcase (8) includes the rigid assembly of front structure (62) and rear structure (66), wherein front armature (64) and rear armature (68) house control shaft bearings (22) for holding cylinder head assembly (18) on crankcase (8) during operation of engine (2).

17. The variable compression ratio mechanism of claim 1, wherein engine (2) has no more than two cylinders (4), and cylinder head assembly (18) has only one cylinder (4), thereby providing a low cost and durable variable compression ratio engine.

18. The variable compression ratio mechanism of claim 17, wherein engine (2) further has a second cylinder head assembly (18*b*), engine (2) further having a generally horizontally opposed piston layout, second cylinder head assembly (18*b*) being located generally on the opposite side of crankshaft (10) from cylinder head assembly (18), second cylinder head assembly (18*b*) having a second control shaft (20*b*) having second control shaft bearings (22*b*).

19. The variable compression ratio mechanism of claim 1, wherein crankcase (8) includes a front structure (62) having a front armature (64), and a rear structure (66) having a rear armature (68), wherein front structure (62) includes a front main bearing support structure (70) for supporting front main bearings (17), and rear structure (66) includes a rear main bearing support (72) for supporting rear main bearings (19), wherein crankcase (8) includes the rigid assembly of front structure (62) and rear structure (66), wherein front armature (64) and rear armature (68) house control shaft bearings (22) for holding cylinder head assembly (18) on crankcase (8) during operation of engine (2)

front structure (62) further includes a second front armature (64*b*), and rear structure (66) further including a second rear armature (68*b*), wherein second front armature (64*b*) and second rear armature (68*b*) houses second control shaft bearings (22*b*) for holding second cylinder head assembly (18*b*) on crankcase (8) during operation of engine (2).

20. The variable compression ratio mechanism of claim 1, further having only one pair of primary control shaft bearings (22) per cylinder head assembly (18), thereby minimizing machining alignment cost.

21. The variable compression ratio mechanism of claim 1, further having only one pair of eccentric bearings (26) per cylinder head assembly (18), thereby minimizing machining alignment cost.

22. The variable compression ratio mechanism of claim 1, further including a first actuator (74) for rotating control shaft (20), and a second cylinder head assembly (18*b*) and a second control shaft (20*b*) having a second actuator (74*b*) for rotating second control shaft (20*b*), wherein second actuator (74*b*) includes independent control means (76) for independent motion control of second control shaft (20*b*) relative to control shaft (20).

23. The variable compression ratio mechanism of claim 1, further having compression ratio lock-up at a first compression ratio setting.

* * * * *